US006840248B2

(12) United States Patent
Zielke

(10) Patent No.: US 6,840,248 B2
(45) Date of Patent: Jan. 11, 2005

(54) METHOD OF AND APPARATUS FOR RECOVERING AND RECYCLING TOBACCO DUST

(75) Inventor: Dietmar Zielke, Hamburg (DE)

(73) Assignee: Hauni Maschinenbau Aktiengesellschaft, Hamburg (DE)

( * ) Notice: Subject to any disclaimer, the term of this patent is extended or adjusted under 35 U.S.C. 154(b) by 0 days.

(21) Appl. No.: 09/783,298

(22) Filed: Feb. 15, 2001

(65) Prior Publication Data

US 2001/0015209 A1 Aug. 23, 2001

(30) Foreign Application Priority Data

Feb. 18, 2000 (DE) ..... 100 07 485

(51) Int. Cl.[7] ..... A24C 1/04
(52) U.S. Cl. ..... 131/96; 131/108; 131/109.2; 131/375
(58) Field of Search ..... 131/96, 108, 109.2, 131/375

(56) References Cited

U.S. PATENT DOCUMENTS

| | | | | |
|---|---|---|---|---|
| 4,003,385 A | | 1/1977 | Adebahr et al. | |
| 4,185,644 A | | 1/1980 | Heitmann et al. | |
| 4,341,228 A | * | 7/1982 | Keritsis et al. | 131/354 |
| 4,373,538 A | | 2/1983 | Steiniger | |
| 4,412,505 A | | 11/1983 | Haüsler et al. | |
| 4,598,721 A | | 7/1986 | Stiller et al. | |
| 4,986,285 A | | 1/1991 | Radzio et al. | |
| 5,135,008 A | | 8/1992 | Oesterling et al. | |
| 5,901,709 A | | 5/1999 | Chehab et al. | |

FOREIGN PATENT DOCUMENTS

| | | |
|---|---|---|
| DE | 25 06 839 | 8/1976 |
| DE | 33 39 247 | 5/1985 |
| DE | 36 24 260 | 2/1987 |
| DE | 42 06 054 | 9/1992 |
| DE | 195 14 925 | 10/1996 |
| EP | 0 254 842 | 2/1988 |
| EP | 0 295 518 | 12/1988 |

* cited by examiner

*Primary Examiner*—Peter Chin
*Assistant Examiner*—Mark Halpern
(74) *Attorney, Agent, or Firm*—Venable LLP; Catherine M. Voorhees

(57) ABSTRACT

Tobacco dust which develops in a machine or production line for the making of smokers' products is put to use in that it is gathered and agglomerated into particles having or exceeding a required size. Metered quantities of such particles are admitted into a stream of fragmentized tobacco leaves before the stream is draped into a web of cigarette paper or the like.

21 Claims, 3 Drawing Sheets

METHOD OF AND APPARATUS FOR RECOVERING AND RECYCLING TOBACCO DUST

CROSS-REFERENCE TO RELATED CASES

The present application claims the priority of the commonly owned copending German patent application Serial No. 100 07 485.5 filed Feb. 18, 2000. The disclosure of the above-referenced German patent application, as well as that of each US and foreign patent and patent application identified in the specification of the present application, is incorporated herein by reference.

BACKGROUND OF THE INVENTION

The present invention relates to improvements in methods of and in apparatus for processing comminuted tobacco leaves, and more particularly to improvements in methods of and in apparatus for recovering and processing (such as recycling) tobacco dust.

Tobacco dust develops in connection with the treatment (such as shredding) of tobacco leaves as well as in connection with further processing of comminuted tobacco leaves and/or of fragments of recycled and artificial tobacco.

It is customary to gather tobacco dust which develops in connection with the comminuting of tobacco leaves as well as in connection with further processing of comminuted (e.g., shredded) tobacco leaf stock. The recovery of tobacco dust is desirable and advantageous for several reasons, namely to clean the air in a tobacco processing plant as well as to recover a relatively high percentage of tobacco, i.e., of the most expensive part of a smokers' product. For example, relatively high quantities of tobacco dust develop in connection with the making of plain cigarettes or other rod-shaped smokers' products. Such dust accumulates in and contaminates the atmosphere around a cigarette making machine or around a production line which includes a cigarette making machine and one or more other machines such as a filter rod making machine and a so-called tipping machine wherein plain cigarettes and filter mouthpieces of unit or multiple unit length are assembled into filter cigarettes of unit or multiple unit length. The means for segregating tobacco dust from the atmosphere surrounding the machines and/or production lines of the above outlined character often includes filters, cyclones and/or other suitable dust-intercepting and collecting arrangements. The thus gathered tobacco dust is recycled or disposed of, i.e., not put to renewed use in a tobacco processing plant.

The reprocessing of tobacco dust in accordance with heretofore known techniques (such as conversion of gathered dust into foils which are thereupon shredded and/or otherwise comminuted to yield shreds or otherwise configurated particles of reconstituted tobacco) is a rather expensive and time-consuming procedure necessitating the utilization of bulky and expensive machinery. On the other hand, disposal of tobacco dust is a wasteful procedure, especially in view of the high percentages of tobacco leaves which are converted into dust during the making of cigarettes and/or other smokable commodities.

OBJECTS OF THE INVENTION

An object of the present invention is to provide a novel and improved method of processing tobacco dust.

Another object of this invention is to provide a method which renders it possible to recover and reprocess all of the collected tobacco dust in a time- and space-saving manner.

A further object of the instant invention is to process tobacco dust in such a way that the processed dust is ready to be introduced or reintroduced into a tobacco processing machine at one or more optimum locations for incorporation into a rod-like filler ready to be draped into a web of cigarette paper or other suitable wrapping material.

An additional object of the invention is to provide a method of recovering tobacco dust and of recycling (reprocessing) recovered tobacco dust by resorting to simple, compact and economical but highly effective apparatus.

Still another object of the invention is to provide a novel and improved apparatus for processing tobacco dust in a time- and space-saving but highly economical manner.

A further object of the invention is to provide an apparatus for processing tobacco dust in such a way that the processed material can be immediately embodied into the filler ready to be converted into the central part of a wrapped tobacco rod, e.g., into the filler of a continuous cigarette rod which is ready to be subdivided into rod-shaped smokers' products of unit length or multiple unit length.

Another object of the invention is to provide an apparatus which can process tobacco dust developing in and/or around a single production line and/or in an entire tobacco processing plant wherein hundreds of cigarette making machines and/or productino lines can turn out huge quantities of smokers' products per unit of time.

An additional object of the invention is to provide novel and improved means for converting tobacco dust into particles which can be more readily manipulated for the making of rod-like fillers in cigarette making and analogous machines.

Still another object of the invention is to provide novel and improved smokers' products having fillers which are or which can be devoid of dust.

A further object of the invention is to provide smokers' products which contain reconstituted tobacco dust.

SUMMARY OF THE INVENTION

One feature of the present invention resides in the provision of a method of processing tobacco dust which develops in the course of the making of tobacco-containing products. The improved method comprises the steps of gathering the dust, and processing gathered dust into particles having sizes greater than the average size of dust.

The processing step can include extruding gathered dust. However, it is often preferred to resort to a processing step wich includes agglomerating gathered dust into particles of required or desired or optimum shape and/or size. The agglomerating step can include compacting gathered duct, preferably by the application of elevated pressure.

The method can further comprise the steps of monitoring the sizes of the particles and comminuting the particles having sizes greater than a predetermined size. The processing step of such method can include processing gathered dust into particles which constitute granules of agglomerated dust.

The method can also include the steps of making a rod-like tobacco filler and embedding the particles in the filler. The step of making the filler can include sifting a mixture of tobacco fragments and the embedding step can include admixing the particles to the mixture upon completion of the sifting step. If the mixture contains fragments of tobacco ribs, the sifting step preferably includes segregating the fragments of tobacco ribs from the mixture. Still further, such method can include the additional step of converting the sifted mixture into a moving stream, and the embedding step can include admixing the particles to the stream. The stream can include or constitute a shower, and the admixing step can include admitting metered quantities of particles to successive increments of the moving stream.

The improved method can further include the step of monitoring the density of the filler, and the embedding step of such method can include introducing the particles into the filler at a rate which is a function of monitored density of the filler.

It is often advisable to resort to an embedding step which includes introducing the particles into the filler at a predetermined rate, e.g., at a gradually variable rate.

Another feature of the present invention resides in the provision of an apparatus for processing tobacco dust which develops in the course of the making of tobacco-containing products. A presently preferred embodiment of such apparatus comprises means for gathering the dust and means for processing gathered dust into particles having sizes greater than the average size of dust. The processing means can include means for agglomerating tobacco dust into particles, and such agglomerating means is preferably set up to operate with the application of pressure, preferably a rather pronounced pressure which is sufficient to reduce the likelihood of breaking up of particles into dust in the course of processing of such particles. The apparatus can further comprise means for comminuting at least those particles which have sizes exceeding a predetermined size.

A further feature of the present invention resides in the provision of a machine for making smokers' products, such as a cigarette making machine. The improved machine comprises means for establishing a supply of comminuted smokable material including tobacco dust, means for segregating the dust from the supply and for gathering the segregated dust into tobacco-containing particles, means for converting the dedusted supply into smokers' products, and means for admitting the particles to the dedusted (i.e., at least substantially dust-free) supply.

The converting means can comprise means for advancing a stream of dedusted supply in a predetermined direction along a predetermined path, and the aforementioned admitting means can include means for supplying the particles into a predetermined portion of the path. The converting means can further comprise means for sifting the stream in a second portion of the path upstream of the predetermined portion, and the admitting means can include means for supplying metered quantities of particles into the predetermined portion of the path.

The novel features which are considered as characteristic of the invention are set forth in particular in the appended claims. The improved machine itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
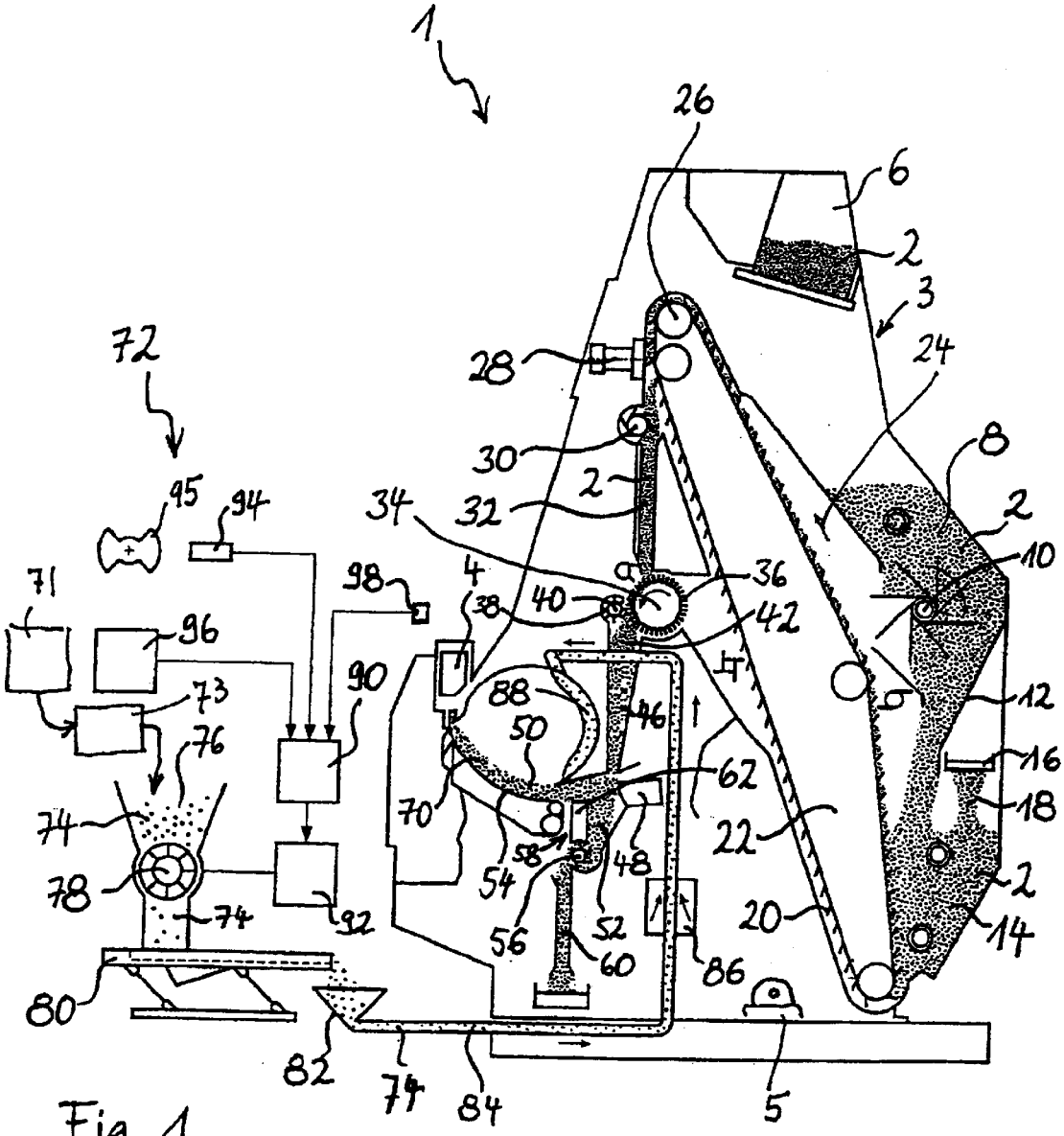
FIG. 1 is a schematic partly elevational and partly sectional view of a cigarette rod making machine wherein tobacco dust is gathered and processed in an apparatus which is constructed and operated in accordance with one embodiment of the present invention.

FIG. 1 illustrates certain constituents of a so-called distributor 1 which serves to process fragments of tobacco leaf laminae and/or other tobacco particles in a cigarette rod making machine. The distributor 1 is an improved version of a distributor of the type described and shown in U.S. Pat. No. 4,373,538 granted Feb. 15, 1983 to Steiniger for "METHOD AND APPARATUS FOR FORMING A STREAM FROM SEVERAL TYPES OF TOBACCO".

The distributor 1 includes a first magazine 8 which receives, either regularly or when necessary, batches of tobacco fragments 2 from a mobile gate 6. Such batches can be dumped and/or otherwise delivered into the magazine 8 in a manner well known in the art, i.e., not forming part of the present invention.

The cigarette rod making machine further comprises an endless foraminous belt conveyor 4 having an endless horizontal or substantially horizontal lower stretch or reach disposed at a level beneath a suction chamber arranged to attract successive increments of a continuous flow or fleece 70 of tobacco particles which form a growing tobacco stream advancing in a direction at right angles to the plane of FIG. 1. Reference may be had, for example, to FIG. 5 of U.S. Pat. No. 4,185,644 granted Jan. 29, 1980 to Heitmann et al. for "DISTRIBUTOR FOR CIGARETTE MAKERS OR THE LIKE".

Whenever the gate 6 opens (e.g., in response to a signal from a sensor which monitors the upper level of the supply of tobacco fragments in the magazine 8), it dumps into this magazine a fresh batch of tobacco fragments. A rotary combing roller 10 has orbiting paddles which advance tobacco fragments 2 along a downwardly sloping sheet metal shroud 12 and into a main magazine 14 located in the lower part of the housing 3 of the distributor 1. A trough-shaped vibratory conveyor 16 discharges into the main magazine 14 a flow 18 of tobacco fragments constituting the surplus which was removed from the tobacco fleece 70 by a standard trimming or equalizing device corresponding to that shown, for example, at 79 in FIG. 5 of the aforementioned U.S. Pat. No. 4,185,644 to Heitmann et al.

One side of the supply of tobacco fragments 2 in the main magazine 14 is in contact with the ascending stretch or reach of an endless belt 22 constituting an elevator conveyor which serves to lift a series of successive accumulations of tobacco fragments 2 into the open top of an upright or substantially upright tobacco gathering duct 32. The belt 22 has a series of vane-like or comb-like elements 20 which entrain discrete accumulations of fragments 2 in the direction of arrow 24 toward and around a pulley or sheave 26 above the open upper end of the duct 32.

A suitable magnet 28 adjacent the path of tobacco fragments 2 descending from the level of the pulley 26 into the duct 32 is set up to attract any metallic particles which might be admixed to the accumulations of tobacco fragments 2 descending from successive vanes 20 toward and into the duct. A paddle wheel 30 is installed at a level below the magnet 28 to uniformize the flow of tobacco fragments 2 on their way from the pockets defined by successive combs or vanes 20 onto the pile of tobacco fragments in the duct 32. FIG. 1 further shows a non-referenced synchronizing paddle wheel adjacent the ascending reach of the elevator belt 22 and several sensors (such as photocells) which are installed in the magazines 8, 14 and serve the same purpose as the corresponding parts of the distributor shown in the aforementioned U.S. Pat. No. 4,373,538 to Steiniger.

The open lower end of the duct 32 discharges tobacco fragments 2 onto the carding 36 of a rotary metering roller 34 which advances successive increments of the layer being formed by the carding 36 into the range of pins 38 at the periphery of a rapidly driven picker roller 40. The latter propels a shower 42 of loose or substantially loose tobacco fragments 2 into a downwardly narrowing funnel-shaped guide 46. A nozzle 48 at the open lower end of the guide 46 discharges one or more horizontal or substantially horizontal jets of compressed air which propel lighter (satisfactory) tobacco fragments 50 (such as shreds of tobacco leaf laminae) onto and along the gradually upwardly sloping upper side of a baffle or guide 54. The heavier tobacco fragments 52 (such as or including pieces of tobacco ribs and/or so-called birds' eyes) traverse the curtain of air which is set up by the orifice(s) of the nozzle(s) 48 and descend by gravity into the range of a so-called cell wheel gate 56. Any lighter fragments 50 which are admixed to the heavier fragments 52 are segregated at 56 and are caused to enter an ascending duct 58 extending along a foraminous wall of a plenum chamber 62 and serving to propel the thus segregated lightweight particles 50 into the fleece 70 at the upper side of the baffle 54. The less satisfactory heavier fragments 52 enter a duct 60 and are evacuated from the distributor 1 by a belt conveyor or in any other suitable manner. The fragments 52 can be processed (such as ground) prior to reintroduction (e.g., at 16) into the distributor 1.

The (satisfactory) lightweight fragments 50 of tobacco (such fragments form the fleece 70) are directed toward the underside of the foraminous belt conveyor 4 and are converted into a stream which is then converted into a rod-like filler in a manner as shown in FIG. 5 of the aforementioned U.S. Pat. No. 4,185,644 to Heitmann et al. Another cigarette making machine which can receive a stream of tobacco fragments 50 from the baffle 54 shown in FIG. 1 of the present application is illustrated, for example, in FIG. 1 of commonly owned U.S. Pat. No. 4,986,285 granted Jan. 22, 1991 to Radzio et al. for "METHOD AND APPARATUS FOR ASCERTAINING THE DENSITY OF WRAPPED TOBACCO FILLERS AND THE LIKE".

FIG. 1 further shows an apparatus or unit 72 which processes gathered tobacco dust in accordance with one presently preferred embodiment of the method of the present invention. The means for gathering tobacco dust (not shown but, for example, illustrated and described in commonly owned U.S. Pat. No. 5,901,709) includes the housing 3 with is provided with one or more fans 5 or analogous devices (only one shown in FIG. 1) which can draw tobacco dust against one or more filters where the dust is gathered and thereupon directed toward and into the processing unit in a manner as will be fully described hereinbelow. The processing unit 72 includes at least one agglomerating device 71, which can be, for example, an apparatus called "Kompaktier/Gramedier maschine RL"built and distributed by "Powtec Maschinen und Engeneering GmbH, Berghauser Str. 62, 42859 Remscheid", which apparatus gathers or converts tobacco dust into particles. In the present invention these particles 74 preferably have a desired size and/or shape for introduction, at 88, into the fleece 70 on the guide 54 upstream of the foraminous conveyor 4 of the cigarette stream forming device in the cigarette rod making machine.

The parts 3, 5 gather tobacco dust, either alone or in conjunction with additional parts in the cigarette rod making machine including the foraminous conveyor 4 and/or in combination with parts serving to gather tobacco dust in a portion of or in the entire plant which contains a substantial number of production lines each of which can include at least one dust gathering cigarette rod maker. For example, each production line can comprise a cigarette maker, a filter rod maker (e.g., of the type disclosed in U.S. Pat. No. 4,412,505 granted Nov. 1, 1983 to Häusler et al. for "APPARATUS FOR APPLYING ATOMIZED LIQUID TO A RUNNING LAYER OF FILAMENTARY MATERIAL OR THE LIKE") and a filter cigarette maker (e.g., of the type disclosed in commonly owned U.S. Pat. No. 5,135,008 granted Aug. 4, 1992 to Oesterling et al. for "METHOD OF AND APPARATUS FOR MAKING FILTER CIGARETTES").

The particles 74 leaving the agglomerating device 71 are caused to pass through a suitable comminuting device 73 serving to reduce the sizes of those particles 74 which are too large for admission into the fleece 70, i.e., into the filler of a cigarette rod. The flow of particles 74 which leave the comminuting device 73 enters a reservoir 76. The latter discharges tobacco particles 74 by way of a rotary metering device 78 which is driven by a prime mover 92, e.g., a variable-speed electric motor receiving signals from the output of a suitable control unit 90. The outlet of the reservoir 76 discharges particles 74 (at the variable rate determined by the metering wheel 78, i.e., by the variable-speed motor 92) into a vibratory trough 80 which uniformizes the flow of particles 74 on their way toward and into a funnel 82 leading into a conduit 84. The latter extends through an injector 86 which propels successive increments of the stream or flow of particles 74 into the channel or conduit 88 which showers the particles 74 onto successive increments of the fleece 70 advancing along the guide 54 toward the underside of the lower reach of the foraminous belt conveyor 4. The just described arrangement has been found to ensure a highly satisfactory distribution of lighter tobacco fragments 50 and particles 74 (agglomerated tobacco dust) in the growing tobacco stream at the underside of the lower reach of the conveyor 4.

The illustrated control unit 90 has several inputs for signals which are processed for the transmission of an appropriate signal to the variable-speed electric motor 92 which drives the metering wheel 78, i.e., which controls the rate of feed of agglomerated and (if necessary) comminuted particles 74 into the range of the injector 86. The reference character 94 denotes a sensor which monitors the momentary speed of the cigarette rod making machine (only a rotary part 95 of such machine is actually shown in FIG. 1). Another sensor 96 monitors the density of the stream which is being built at the underside of the lower reach of the conveyor 4. A further sensor 98 transmits a signal denoting the length of cigarettes being produced by the rod making machine. The signals from the sensors 94, 96 and 98 are processed by the control circuit 90, and the output of this circuit transmits corresponding signals to the variable-speed motor 92.

Figure 2:
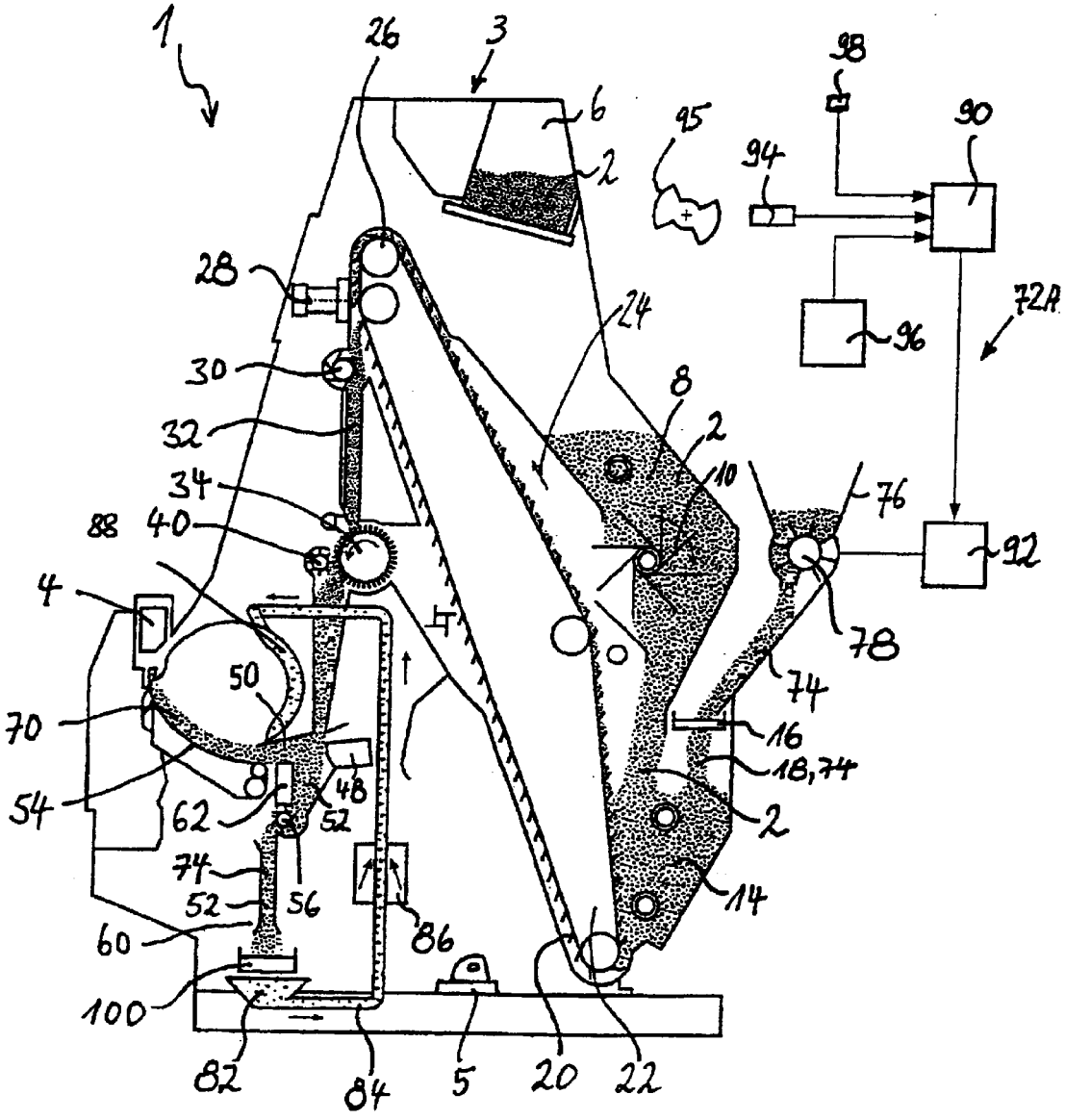
FIG. 2 is a similar view of a modified machine.

FIG. 2 illustrates a portion of a modified cigarette rod making machine wherein the distributor 1 is or can be identical with the similarly referenced distributor of FIG. 1. However, the tobacco dust processing unit 72A of FIG. 2 is different in that it is set up to deliver tobacco particles 74 containing compacted tobacco dust into the main magazine 14 of the distributor 1. Therefore, the sifting channel 60 in the machine including the distributor 1 of FIG. 2 not only contains fragments 52 of tobacco ribs but also some particles 74, and such particles are caused to pass through a classifying conveyor 100 for the fragments 52 of ribs and enter the funnel 82 for delivery onto the fleece 70 by way of the conduit 84, injector 86 and conduit 88.

The variable-speed prime mover 92 of FIG. 2 drives a metering wheel 78 which delivers a flow of particles 74 into the vibrating conveyor 16 for returned tobacco surplus 18, and the conveyor 16 delivers a mixture of particles 74 and surplus 18 into the main magazine 14 wherein such mixture is intermingled with the tobacco fragments 2 received from the magazine 8 via combing roller 10. The manner in which the sensors 94, 96 and 98 transmit signals to the control circuit 90 and in which such circuit processes the signals to control the speed of the variable-speed motor 92 for the metering wheel 78 is or can be the same as already described with reference to FIG. 1. The manner in which the agglomerating device 71 and the comminuting device 73 (these devices are not shown in FIG. 2) cooperate to deliver tobacco particles 74 into the reservoir 76 for the metering wheel 78 of FIG. 2, too, is or can be the same as already described with reference to FIG. 1.

An advantage of the cigarette rod making machine embodying the structure of FIG. 2 is that the particles 74 are uniformly admixed to the shreds 50 before they reach the nozzle 48 and that at least a very high percentage of particles 74 shares the movements of shreds 50 all the way from the main magazine 14 to the guide 54.

The classifying conveyor 100 is designed to intercept the fragments 52 of tobacco ribs but to permit the particles 74 to pass so that such particles can enter the conduit 84 via funnel 82. The thus intercepted particles 74 are propelled by the injector 86 to enter the conduit 88 and to be distributed on the fleece 70 upstream of the foraminous conveyor 4 of the cigarette rod making machine.

Figure 3:
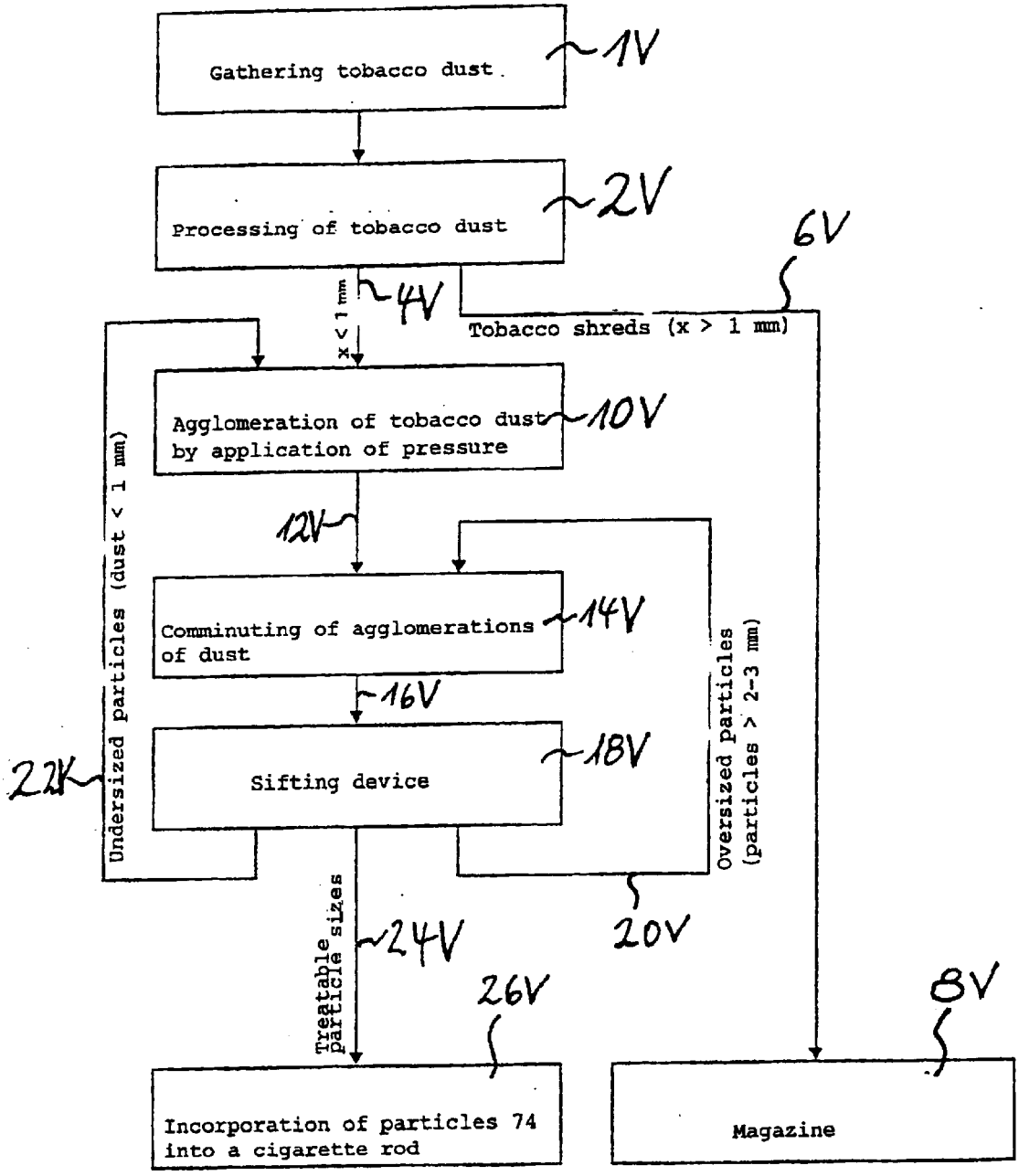
FIG. 3 is a diagram wherein the blocks denote various steps of a method embodying one form of the present invention.

The blocks of the diagram shown in FIG. 3 illustrate the steps of the improved method.

The block 1V represents the step of gathering tobacco dust (e.g., in a manner as shown schematically at 3, 5 in FIG. 1). Thus, the tobacco dust intercepting and gathering means can include at least one cyclone 5 and at least one filter, e.g., a filter forming part of or borne by the housing 3 and being designed to intercept and collect tobacco dust but to permit the thus cleaned air to pass therethrough. The filter or filters can consist of a textile or any other suitable material which is foraminous to the extent necessary to intercept tobacco dust.

The block 2V of FIG. 3 denotes a part of the dust gathering means, such as a part of the agglomerating unit 71 of FIG. 1. This agglomerating unit can include means for sifting the tobacco dust and any other fragments which are intercepted at 1V. If the material which was intercepted and gathered at 1V contains some shreds (50) or analogous fragments of a size and quality adequate for admixture to the bulk of the shreds 50, such shreds are delivered (at 6V) into a magazine 8V (this can constitute or form part of or include the magazine 8 or 14 of FIG. 1 or the vibratory conveyor 16).

For example, the structure denoted by the block 2V can be designed to convey fragments larger than 1 mm into the pipe or conveyor 6V and hence into the magazine 8V; on the other hand, fragments (dust) smaller than 1 mm are conveyed by the conduit 4V to enter the dust which aggomerated (preferably by resorting to the application of adequate pressure) to be gathered into particles 74 having a size exceeding a predetermined size, namely a size which is adequate to warrant admission of such particles (74) into the reservoir 76 of FIG. 1 or 2.

The block 10V represents an agglomerating device which preferably agglomerates tobacco dust with the application of elevated (preferably very high) pressure, i.e., to compact batches of dust having sizes below 1 mm into particles of a size adequate for predictable incorporation into the fleece 70, i.e., into a stream which can be trimmed and otherwise processed to form a continuous rod-like filler ready to be wrapped into a running web of cigarette paper or the like.

The agglomerating device (block 10V) supplies tobacco particles 7 (at 12V) into a comminuting device 73 (block 14V). For example, the device 73 can break up relatively large particles 74 into acceptable particles having a size in the range of between about 1 and 3 mm. This can involve a grinding, a cutting or any other suitable comminuting action upon the relatively large particles 74.

The thus obtained mixture including acceptable particles 74 leaves, at 16V, the comminuting device denoted by the block 14V and enters a sifting device denoted by the block 18V. The purpose of sifting is to segregate from the particles 74 any dust which has developed at the comminuting station (block 14V) as well as to segregate from the particles 74 any fragments (e.g., fragments of so-called birds' eyes and/or ribs) which could make holes in the tubular wrappers of cigarette paper or the like. For example, the block 18V can denote a so-called wobbling type classifying device.

The segregated large fragments (e.g., those having diameters of between 2 and 3 mm or even larger) are fed (at 20V) back to the comminuting device (block 14V); on the other hand, fragments which can be classified as dust (e.g., because they have diameters not exceeding 1 mm) are conveyed (at 22V) back to the agglomerating device (block 10V) to be converted into parts of particles 74.

The mixture which consists solely of acceptable agglomerated particles 74 is fed (at 24V) to the locus or loci of admission (at 26V) into the future filler of a continuous cigarette rod, e.g., into the fleece 70 on the guide 54 in the structure shown in FIG. 1.

In accordance with a modification, the agglomerating device (such as the device 71 shown in FIG. 1) can be replaced by or utilized interchangeably with a suitable extruder (also represented by the block 10V of FIG. 3).

An important advantage of the improved method and apparatus (and of the machine or production line embodying such apparatus) is that all of the collected or collectable tobacco dust can be put to use in a surprisingly simple and economical manner. One of the reasons is that the particles 74 (especially those produced in an agglomerating device which is operated at an elevated or greatly elevated pressure) can be readily processed (such as uniformly distributed in the rod-like filler of a cigarette rod or the like) in a very simple and space-saving manner as well as at a rate which is desirable or necessary in a modern high-speed machine for the making of rod-shaped smokers' products.

Another highly desirable and advantageous feature of the improved method and apparatus is that it is not necessary to establish and maintain one or more storage facilities for huge quantities of collected tobacco dust. Thus, tobacco dust can be processed into tobacco particles (74) of optimum size and/or shape at the rate at which the dust is being collected in a machine, in a production line or in a tobacco processing plant. By the same token, the particles 74 can be admitted into the tobacco fleece 70 at the rate at which they are being supplied by the agglomerating device 71 and/or by an equivalent device (such as the aforementioned extruder).

The quality of the particles 74 (agglomerated and/or extruded tobacco dust) is or can be just as high as that of fragments (50) being furnished by the gate 6 from a tobacco shredding machine. This amounts to substantial savings in tobacco (i.e., in by far the most expensive constituent of cigarettes and analogous smokers' products). It is presently preferred to convert tobacco dust into particles 74 having a granular consistency.

It is often desirable to gather tobacco dust in such a way that the dust obtained from a given brand of tobacco is gathered (as at 3, 5 in FIG. 1) for conversion into particles 74 which are thereupon introduced into a tobacco stream ready to be converted into the filler of a cigarette rod containing that particular or given brand of tobacco. This ensures that the admission of particles 74 does not affect the taste and/or aroma of tobacco smoke, i.e., that the admission of preferably granular particles 74 in no way affects the flavor of tobacco in the finished smokers' products, such as plain or filter cigarettes, cigars, cigarillos and the like.

A further important advantage of the improved method and apparatus is that the apparatus can be embedded in and/or otherwise directly associated with a machine or production line for the making of smokers' products. Thus, it is not necessary, or not always necessary, to install the dust gathering and dust processing equipment at a distance from the machine in which the particles 74 are being put to use. As a rule, this entails substantial savings in space as well as in piping, conveyors and the like because the particles 74 and/or their equivalents need not be transported through considerable distances, e.g., from a dust intercepting, gathering and processing station to the locus of introduction of particles 74 into a tobacco stream (such as the fleece 70 shown in FIGS. 1 and 2).

An additional important advantage of the improved method and apparatus is that, due to the possibility of immediately reusing tobacco dust (and more specifically the dust which was removed from a machine shortly or immediately prior to its conversion into particles 74), the quality including the taste of such tobacco does not undergo any undesirable change, or any appreciable change, so that the readmission of processed dust into the machine in or at which the dust was processed into particles 74 does not affect the taste of the smokers' products being made in such machine.

The conversion of tobacco dust into particles 74 and the incorporation of such particles into a rod-like tobacco filler can take place with a minimum of delay; this is due to the fact that, and especially if the processing involves agglomeration in the presence of pronounced pressure, such processing need not involve, and need not be preceded or followed by, any additional treatment. For example, the dust need not be moistened, it need not be mixed with any binder material (such as adhesive), and it need not be mixed with and/or otherwise treated by one or more additives. Consequently, the agglomerating step need not be preceded by any time-consuming and/or other cost-increasing step or steps, and such agglomerating step need not be followed by drying of the particles 74. In fact, even the comminuting step (as at 73) can be omitted because the larger particles can be segregated from particles of desired size by resorting to a sifting operation (as denoted by the block 18V in the diagram of FIG. 3).

However, the above-enumerated advantages of the making of particles 74 directly in or at a cigarette making machine or production line do not detract from the advantages of the establishment of a larger facility which processes tobacco dust gathered in a relatively large section of a cigarette making or like plant, or even in an entire plant of such nature. For example, the establishment of a single central facility for the processing of gathered tobacco dust into particles 74 of a desired size and/or shape exhibits the advantage that such facility requires a single agglomerating and/or a single extruding device as well as a single comminuting device (if such device is needed at all).

As a rule, one or more comminuting devices (see the device 73 in the apparatus of FIG. 1 and the block 14V in the diagram of FIG. 3) will be required or their utilization will be advisable if the manufacturer wishes to turn out cigarettes or the like wherein the tobacco-containing filler should not contain additional particles (e.g., particles in addition to tobacco shreds and/or shreds of reconstituted and/or substitute tobacco) having sizes exceeding a preselected (predetermined) size.

The classifying unit 100 of FIG. 2 exhibits the advantage that it even further reduces the likelihood of undesirable evacuation of satisfactory particles 74 (i.e., of processed tobacco dust) from a cigarette rod making machine, e.g., jointly with fragments of tobacco ribs, birds' eyes and/or similar parts which should not enter the stream that is ready for conversion into the filler of a continuous cigarette rod or the like. Thus, and as already described with reference to FIG. 2, the conveyor 100 is designed to reliably evacuate the fragments 52 but permits the processed tobacco dust (particles 74) to enter the funnel 82 on its way into the channel or conduit 88. Reference may also be had to published German patent applications Nos. 3 624 260 A1 and 4 206 054 A1.

To summarize: An important feature of the improved method resides in the provision of steps of gathering tobacco dust and converting the gathered dust into particles of optimum size or within a desirable range of sizes. It is often preferred to resort to a converting step which includes or constitutes agglomeration, preferably with the application of pressure. The sizes of the granulae should not be too large because this could entail pronounced fluctuations of the weight of ultimate products, such as cigarettes. On the other hand, the weight of the granulae should not be too low because this could result in the making of a relatively high percentage of dust in the course of further treatment such as the conveying of granulae toward the location or locations of embedding into a tobacco stream and/or subsequent treatment of a stream or flow or fleece containing a relatively high percentage of tobacco dust. A presently preferred size of granulae is within the range of between about 1 and 3 mm. Such granulae can but need not necessarily resemble or constitute spherical particles.

Conversion or gathering of dust into particles (such as granulae) having a size sufficiently exceeding that of tobacco dust by resorting to the application of relatively high pressures (such as in the course of an agglomerating step) is desirable on the ground that such treatment reduces the likelihood of generation of a relatively high percentage of dust during the next-following treatment, especially in the course of comminution (such as at 73 in the machine including the structure shown in FIG. 1) if the agglomerating step results in the making of a percentage of large particles which is high enough to warrant or to necessitate resort to a subsequent comminuting step (such as a crushing, grinding or analogous treatment). For example, a comminuting treatment in a cutting or grinding mill could result in total conversion of particles (such as 74) into dust; this is an important reason for the application of an agglomerating step which is carried out by resorting to the application of pronounced compressive forces.

The likelihood of the just discussed total or substantial reconversion of particles (74) into tobacco dust should be avoided because this would necessitate renewed conversion of the thus (non-intentionally) obtained tobacco dust back into particles of appropriate, desirable, acceptable and/or optimum size. It is desirable to select the pocessing of gathered tobacco dust in such a way that more than 50 percent of such dust is converted into stable particles of desired size.

The admission of particles (74) into a flow of tobacco shreds (such as 50) at a rate which is a function of one or more important parameters (such as those monitored at 94, 96 and/or 98) is desirable and advantageous in many instances. The selection of the rate of admixing of particles (74) into the mass of shreds 50 or the like in dependency upon the density of the stream or flow or fleece (such as that shown shown at 70 in FIG. 1 or 2) is always desirable because this results in a sought-after predictability of the percentage of particles 74 in the fillers of the ultimate rod-shaped smokers' products. In addition, such predictability of the percentage of particles 74 (or similar or analogous or equivalent particles) in the fillers of the ultimate products can be achieved by resorting to relatively simple, compact, reliable and long-lasting and readily available instrumentalities (such as the control circuit 90 and the sensor 96).

The metering wheel 78 (or an equivalent thereof) also constitutes a relatively simple and inexpensive but highly advantageous feature of the improved apparatus, even if its operation is regulated by resorting to fewer than three sensors (e.g., to the sensor 94 or 96 or 98, or to the sensors 94, 96 or 94, 98 or 96, 98).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of processing tobacco dust and, therefore, such adaptations should and are intended to be comprehended within the meaning and range of equivalence of the appended claims.

What is claimed is:

1. A method of processing tobacco dust which develops in the course of the making of tobacco-containing products, comprising the steps of:

gathering the dust;

processing gathered dust into particles having sizes greater than the average size of dust;

monitoring the sizes of the particles; and comminuting the particles having sizes greater than a predetermined size.

2. The method of claim 1, wherein said processing step includes extruding gathered dust.

3. The method of claim 1, wherein said agglomerating step includes compacting gathered dust.

4. The method of claim 1, wherein the processing step includes processing gathered dust into particles constituting granules of agglomerated dust.

5. The method of claim 1, further comprising the steps of making a rod-like tobacco filler, and embedding the particles in the filler.

6. The method of claim 5, wherein said step of making the filler includes sifting a mixture of tobacco fragments, said embedding step including admixing the particles to the mixture upon completion of said sifting step.

7. The method of claim 6, wherein the mixture contains fragments of tobacco ribs and said sifting step includes segregating the fragments of tobacco ribs from the mixture.

8. The method of claim 7, further comprising the step of converting the sifted mixture into a moving stream and said embedding step including admixing the particles to the stream.

9. The method of claim 8, wherein said stream is a shower.

10. The method of claim 8, wherein said admixing step includes admitting to successive increments of the moving stream metered quantities of particles.

11. The method of claim 5, further comprising the step of monitoring the density of the filler and said embedding step includes introducing the particles into the filler at a rate which is a function of monitored density of the filler.

12. The method of claim 5, wherein said embedding step includes introducing the particles into the filler at a predetermined rate.

13. The method of claim 12, wherein said rate is a gradually variable rate.

14. The method of claim 1, wherein processing step does not include extruding the gathered dust into said particles.

15. The method of claim 1, wherein processing step gathers the dust into particles of dust with size of between about 1 mm to about 3 mm.

16. Apparatus for processing tobacco dust which develops in the course of the making of tobacco-containing products, comprising;

means for gathering the dust;

means for processing gathered dust into particles having sizes greater than the average size of dust; and means for comminuting at least the particles having sizes exceeding a predetermined size.

17. The apparatus of claim 16, wherein said agglomerating means includes means for converting dust into particles with the application of pressure.

18. A machine for making smokers' products, comprising:

means for establishing a supply of comminuted smokable material including tobacco dust;

means for segregating the dust from the supply and for gathering the segregated dust into tobacco-containing particles, said gathering and segregating means including means for comminuting at least the tobacco-containing particles having sizes exceeding a predetermined size;

means for converting the dedusted supply into smokers' products; and means for admitting the particles to the dedusted supply.

19. The machine of claim 18, wherein said converting means comprises means for advancing a stream of dedusted supply in a predetermined direction along a predetermined path, said means for admitting including means for supplying the particles into a predetermined portion of said path.

20. The machine of claim 19, wherein said converting means further comprises means for sifting the stream in a second portion of said path upstream of said predetermined portion.

21. The machine of claim 19, wherein said admitting means includes means for supplying metered quantities of particles into said predetermined portion of said path.

* * * * *